US006662978B2

(12) United States Patent
Lin et al.

(10) Patent No.: US 6,662,978 B2
(45) Date of Patent: Dec. 16, 2003

(54) STOPPER WITH INTERCHANGEABLE PLUG

(76) Inventors: Shin-Shuoh Lin, 27022 Falling Leaf Dr., Laguna Hills, CA (US) 92653; Ji-Jun Wu, 27022 Falling Leaf Dr., Laguna Hills, CA (US) 92653

( * ) Notice: Subject to any disclaimer, the term of this patent is extended or adjusted under 35 U.S.C. 154(b) by 0 days.

(21) Appl. No.: 10/144,299

(22) Filed: May 13, 2002

(65) Prior Publication Data

US 2003/0209574 A1 Nov. 13, 2003

(51) Int. Cl.[7] ..... B65D 47/28; A47J 41/02
(52) U.S. Cl. ..... 222/509; 222/518
(58) Field of Search ..... 222/509, 518

(56) References Cited

U.S. PATENT DOCUMENTS

| | | | | |
|---|---|---|---|---|
| 3,220,695 A | * | 11/1965 | Downey et al. | 251/263 |
| 4,754,888 A | | 7/1988 | Letch et al. | |
| 4,960,218 A | * | 10/1990 | Toida et al. | 215/311 |
| 5,249,703 A | | 10/1993 | Karp | |
| D346,933 S | | 5/1994 | Denny et al. | |
| 5,392,967 A | * | 2/1995 | Satomi et al. | 222/509 |
| D362,156 S | | 9/1995 | Goto et al. | |
| D362,369 S | | 9/1995 | Bridges | |
| D373,051 S | | 8/1996 | Kramer et al. | |
| D386,948 S | | 12/1997 | Wissinger | |
| D396,777 S | | 8/1998 | Inoue | |
| D398,187 S | | 9/1998 | Parker | |
| D411,713 S | | 6/1999 | Bridges | |
| 5,918,761 A | | 7/1999 | Wissinger | |
| D416,757 S | | 11/1999 | Ginuntoli | |
| D425,758 S | | 5/2000 | Freed | |
| 6,299,037 B1 | * | 10/2001 | Lee | 222/518 |
| 6,443,336 B2 | * | 9/2002 | Antonetti et al. | 222/509 |

FOREIGN PATENT DOCUMENTS

| | | | | |
|---|---|---|---|---|
| JP | 08117119 A | * | 5/1996 | A47J/41/02 |
| JP | 2002051919 A | * | 2/2002 | A47J/41/02 |

* cited by examiner

*Primary Examiner*—Kenneth Bomberg
(74) *Attorney, Agent, or Firm*—Gordon K. Anderson

(57) ABSTRACT

A liquid storage vessel stopper, having interchangeable plugs is taught, that utilizes a stopper body (20) with an inner shell (22) affixed to an outer shell (24). The inner shell is configured to communicate with a liquid storage vessel interior, and the outer shell is profiled to be threadably attached to the vessels outside surface. An interchangeable stopper plug is either a twist to pour plug or a push to pour plug type. The former has a main core (32) smaller than the inner shell, and incorporates a lid (36) creating a dead air space within forming an insulating barrier. When the main core is manually rotated at least a quarter of a turn, the plug is unseated and a flow path is opened between the core and the inner shell permitting liquid contents to be poured from the vessel. The push to pour plug has a push button (46) that opens a pathway through the plug such that when depressed a first time, the push button urges a force ring (52) down while simultaneously unseating a valve plunger (64) allowing a passageway through the plug and inner shell, permitting liquid to be poured from the stopper. When push button is depressed a second time the plug disengages, under spring pressure, and returns to a normally closed position terminating the flow of liquid through the stopper.

8 Claims, 6 Drawing Sheets

STOPPER WITH INTERCHANGEABLE PLUG

TECHNICAL FIELD

The present invention relates to stoppers for insulated liquid containing vessels in general. More specifically to a stopper that has interchangeable plugs for sealing and pouring liquid therefrom.

BACKGROUND ART

Previously, many types of stoppers have been used in endeavoring to provide an effective means to enclose a liquid containing vessel such as a vacuum insulated bottle, a coffee server, carafe, travel container or the like.

A the following prior art did not disclose any patents that possess any of the novelty of the instant invention, however the following U.S. patents are considered related:

| Patent Number | Inventor | Issue Date |
|---|---|---|
| Des. 346,933 | Denny et al. | May 17, 1994 |
| Des. 362,156 | Goto et al. | Sep. 12, 1995 |
| Des. 362,369 | Bridges | Sep. 19, 1995 |
| Des. 373,051 | Kramer et al. | Aug. 27, 1996 |
| Des. 386,948 | Wissinger | Dec. 02, 1997 |
| Des. 396,777 | Inoue | Aug. 11, 1998 |
| Des. 398,187 | Parker | Sep. 15, 1998 |
| Des. 411,713 | Bridges | Jun. 29, 1999 |
| Des. 416,757 | Ginuntoli | Nov. 23, 1999 |
| Des. 425,758 | Freed | May 30, 2000 |
| 4,754,888 | Letsch et al | Jul. 05, 1988 |
| 5,249,703 | Karp | Sep. 05, 1993 |
| 5,918,761 | Wissinger | Jul. 06, 1999 |

Letsch et al. in U.S. Pat. No. 4,754,888 discloses a carafe with an inner container surrounded by a casing. The inner container and the casing have an opening at the top which may be closed by a separate plug. The plug and opening in the container and casing are shaped such that it is possible to fill or empty the inner container while the plug is still in the opening. The plug and container both have mating grooves that provide opposed flow paths into and out of the container. The container also includes a basin around the top for receiving coffee from a coffee maker and the plug has openings to provide a flow path from the basin into the container interior.

Karp in U.S. Pat. No. 5,249,703 teaches a travel mug that includes a container and a lid in combination. The container has a handle and an annular lip that has an annulus capable of forming a seal with the top side of the annular lip. A cylindrical well in the lid has a vertical dividing wall such that the lid may be readily rotated by hand. The retaining arms extend from the underside of the lid and engage the underside of the annular lip to pull it into tight abutment. Diametrically opposed gaps in the lip act as passageway for the retaining arms. Similarly diametrically opposed notches in the lid align with the gaps to allow liquid to be poured from the container.

U.S. Pat. No. 5,918,761 issued to Wissinger is for an insulated container and cover combination that has an outer container shell terminating at an opening with a surrounding edge. An inner container shell is nested within the, outer container shell and has an opening surrounded by a continuous edges in abutment with the surrounding edge. The inner container shell is spaced inwardly and is out of contact with the outer shell. A cover mounting assembly is attached to the outer shell adjacent to the opening. A single seal, made of elastomeric material, has a sealing surface disposed at the interface of the shells Locating rings define the removable cover mounting assembly and locate the single sealing ring on the inner and outer shells.

For background purposes and as indicative of the art to which the invention is related reference may be made to the remaining cited design patents.

DISCLOSURE OF THE INVENTION

Stoppers for vacuum bottles, liquid containing vessels and the like utilizing external threads on the outside surface were previously rather simple in their construction being screwed off to allow the contents to be poured from the mouth of the container. In some instances a separate cup was screwed on the threads and a stopper plug was manually inserted into the opening of the vessel. Today much more sophisticated stoppers are in common usage. Normally the lid is turned a small amount to allow the liquid to be expelled and retighten by simple reversal of the lid. Little thought has been given to a stopper that has the capability to be manufactured in such a manner as to permit the tooling to produce part of the stopper as standard and then have options as to the method of operation by replacing a separate and discrete plug that forms the assembly.

It is therefore a primary object of the invention to produce a stopper having interchangeable plugs with each plug operating in a different manner. This invention incorporates a stopper body made up of two components mated together and a annular gasket for sealing against the neck of the vessel. An inner shell interfaces with the plug and has a smooth contour for ease of pouring and threads on a lower portion for attaching a plug. An outer shell is attached to the inner shell and incorporates a set of threads that interface with opposed threads of a ordinary liquid storage container.

An important object of the invention is directed to the two different plugs that fit into the common stopper body. The first plug is a twist to pour type, and as the name suggests, it operates by twisting a hollow main core that rotates on the threads of a lower portion of the stopper body inner shell. Slight rotational movement of the plug raises the plug sufficiently to expose a flow path under a peripheral core gasket allowing the liquid within the container to flow freely therefrom. The second plug operates by pushing a button in the top cover a first time locking the plug in an open position. When pushing the button the second time the plug returns to its closed position by spring pressure and retains a liquid tight seal. This first approach is called a push to pour plug.

Another object of the invention is that that the twist to pour embodyment includes a lid on the main core that creates a dead air space producing an insulating barrier that prolongs the desired temperature gradient of the liquid stored within the container.

Yet another object of the invention is that a manufacturer may fabricate a single stopper body and offer either or both plugs as options or may market either combination according to what the public demands. This object saves considerable tooling expense in the initial investment while reducing the speculation of the products acceptance.

These and other objects and advantages of the; present invention will become apparent from the subsequent detailed description of the preferred embodiment and the appended claims taken in conjunction with the accompanying drawings.

BEST MODE FOR CARRYING OUT THE INVENTION

Figure 1:
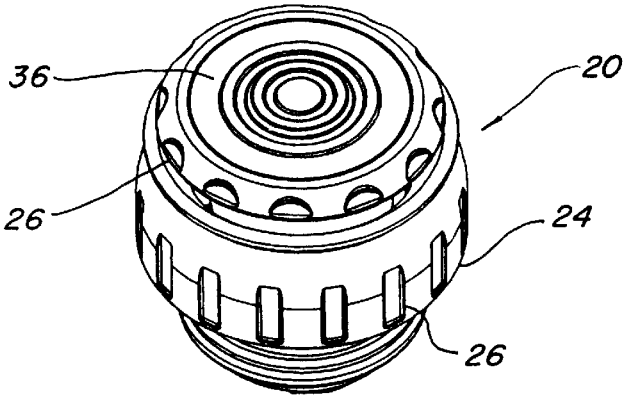
FIG. 1 is a partial isometric view of the twist to pour embodiment of the stopper.
Figure 2:
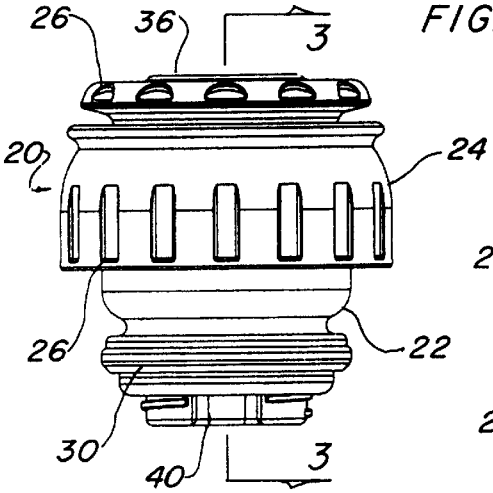
FIG. 2 is a side elevation view of the twist to pour embodiment of the stopper.
Figure 8:
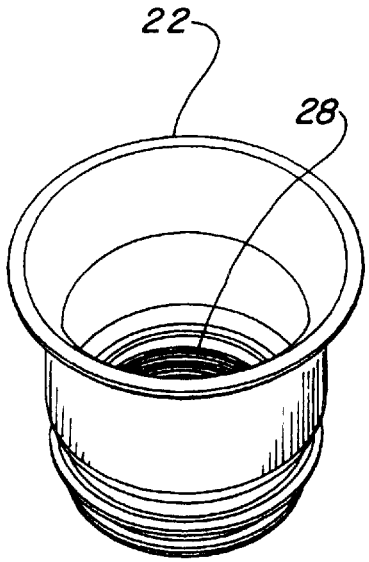
FIG. 8 is a partial isometric view of the stopper body inner shell of the twist to pour embodiment of the stopper completely removed from the invention for clarity.
Figure 7:
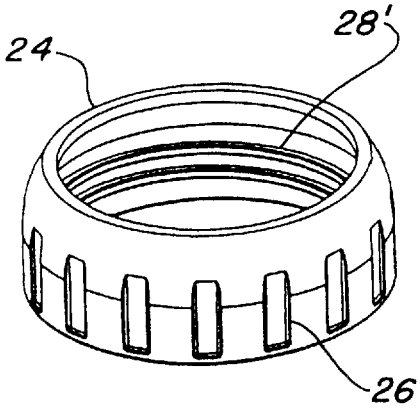
FIG. 7 is a partial isometric view of the stopper body outer shell of the twist to pour embodiment of the stopper completely removed from the invention for clarity.

The best mode for carrying out the invention is presented in terms of a preferred embodiment with optional sub-elements. The twist to pour embodiment, that is preferred, is shown in FIGS. 1 thorough 12 and is comprised of a stopper body 20 having an inner shell 22 affixed to an outer shell 24. The inner shell 22 is configured to communicate with a liquid storage vessel interior and includes a plurality of recesses 26 for providing a gripable surface for attachment to a vessel. The outer shell 24 is profiled to be threadably attached to an outside surface of the same vessel. FIGS. 1–5 and 12 illustrate the entire stopper body 20 and FIG. 8 illustrates the inner shell 22 by itself FIG. 7 shows the outer shell 24 also completely removed from the invention.

Figure 3:
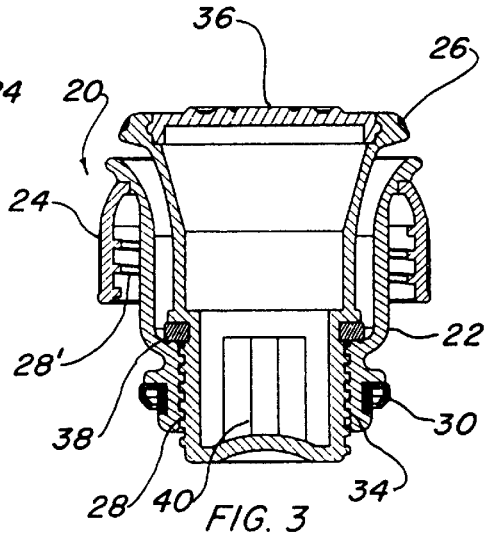
FIG. 3 is a cross sectional view taken along lines 3—3 of FIG. 2.
Figure 4:
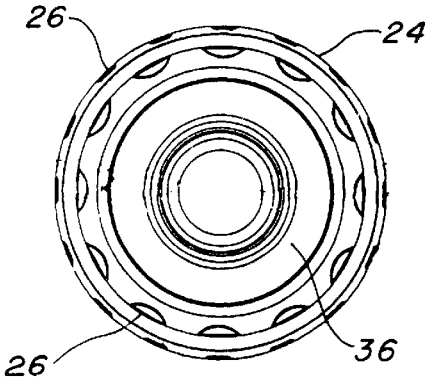
FIG. 4 is a top elevation view of the twist to pour embodiment of the stopper.
Figure 5:
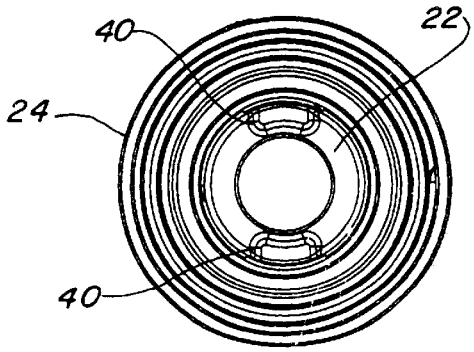
FIG. 5 is a bottom view of the twist to pour embodiment of the stopper.
Figure 6:
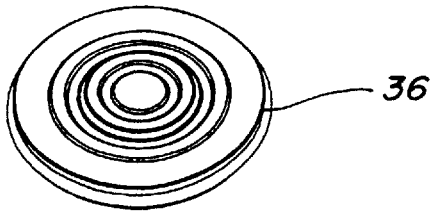
FIG. 6 is a partial isometric view of the of the top of the twist to pour embodiment of the stopper completely removed from the invention for clarity.
Figure 10:
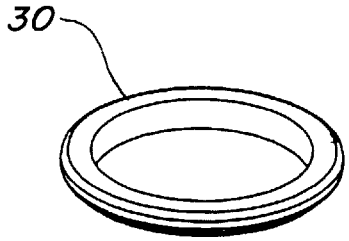
FIG. 10 is a partial isometric view of the annular gasket of the twist to pour embodiment of the stopper completely removed from the invention for clarity.
Figure 11:
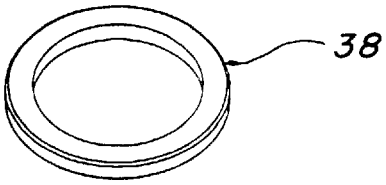
FIG. 11 is a partial isometric view of the peripheral core gasket of the twist to pour embodiment of the stopper completely removed from the invention for clarity.
Figure 12:
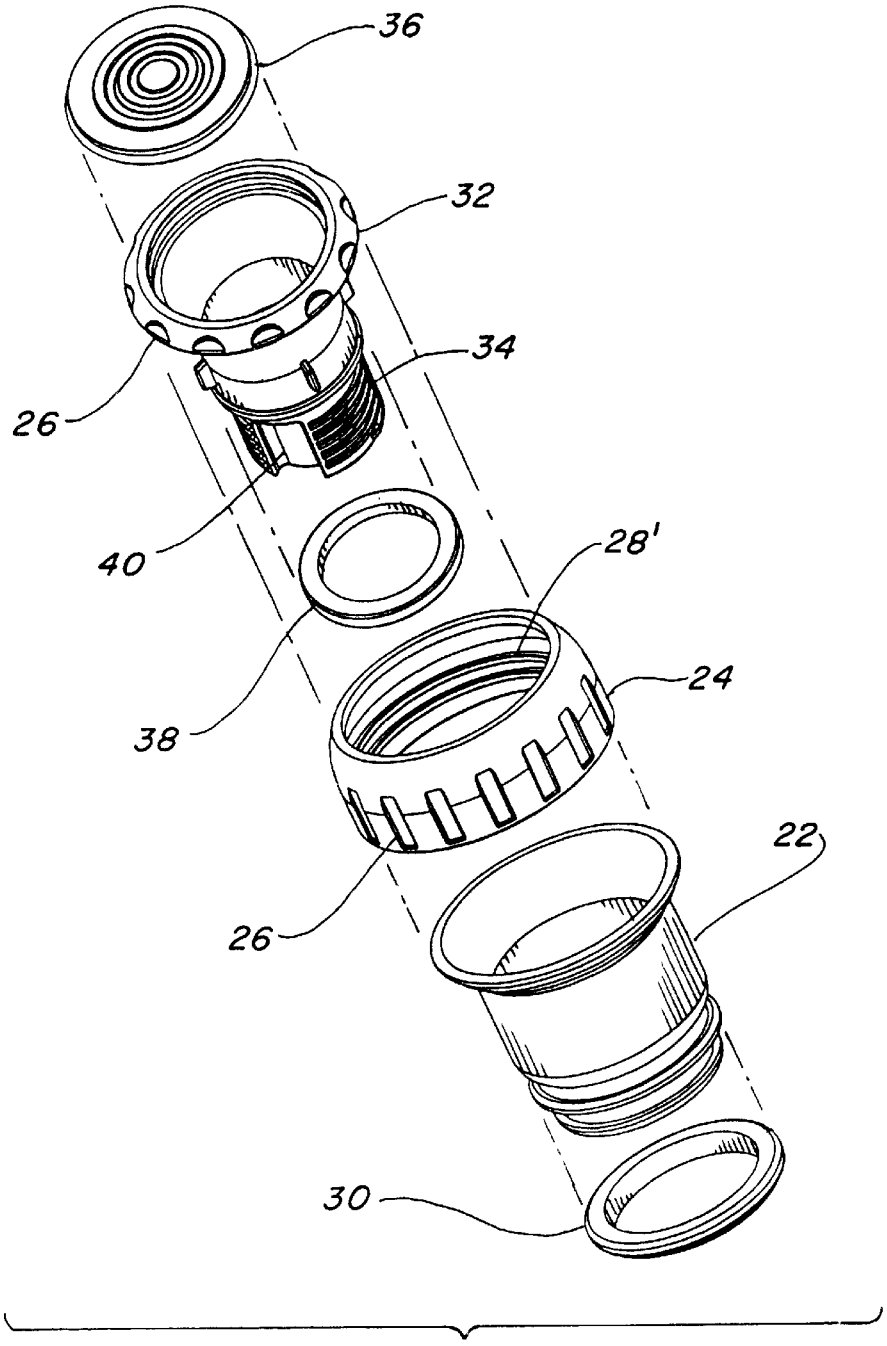
FIG. 12 is an exploded view of the twist to pour embodiment of the stopper.

Inner shell threads 28 interface with a stopper plug, and a annular gasket 30 is seated thereon for sealing the inner shell 22 to a storage vessel interior, in a liquid tight manner. The outer shell 24 has similar threads 28' for interfacing with the opposed threads of a liquid storage vessel. It should be realized that the stopper body 20 includes the inner shell 22, outer shell 24 and the annular gasket 30 as shown in the exploded view of FIG. 12 depicted as the three lower elements and independently in FIGS. 7, 8, and 10. Further the inner shell 22 and outer shell 24 are physically attached together and sealed into an integral unit as illustrated in FIG. 3.

The stopper body 20 is formed of a thermoplastic such as cellulose, phenolic, phenylene oxide, polycarbonate, polyester, polyethylene, polypropylene, polystyrene, acetyl, polyester, phenylene oxide, polymide or poly vinyl chloride. The annular gasket 30 is made of a thermoplastic material analogous to natural rubber, synthetic rubber and resilient thermoplastic, specifically including silicone, neoprene, and viton.

The interchangeable stopper plug, in the form of a push to pour plug, is illustrated as the top three elements of FIG. 12 and consists of a hollow main core 32 that is smaller in size yet contoured in like manner as the stopper body inner shell 22 interior, with core mating threads 34 that connect to the body inner shell threads 28 for interfacing with a stopper plug. The main core 32 of the plug is shown individually in FIG. 9 and a lid 36 is snapped into place and sealed onto the hollow main core 32 enclosing the core creating a dead air space within, that acts as an insulating barrier for the liquid containing vessel. A peripheral core gasket 38 hermetically seals the core 32 to the stopper body inner shell 22, as shown best in FIG. 3. The main core 32 and lid 36 are of the same material as the stopper body 20 and the peripheral gasket 38 material is a duplicate of the annular gasket 30.

Figure 9:
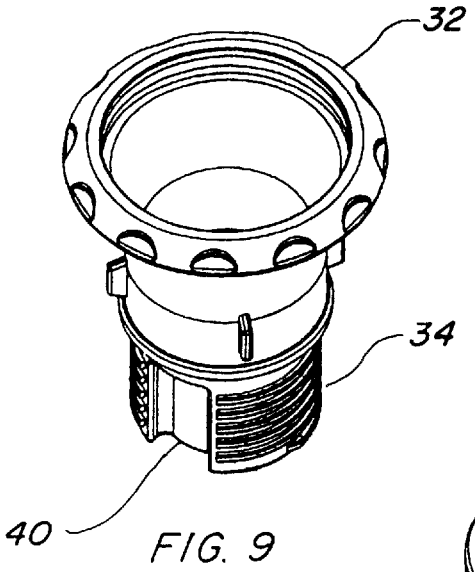
FIG. 9 is a partial isometric view of the hollow main core of the twist to pour embodiment of the stopper completely removed from the invention for clarity.

The core mating threads 34 have interruptions in the form of a pair of opposed cavities 40 such that when the twist to pour plug main core 32 is manually rotated at least a quarter of a turn the peripheral gasket 38 is unseated. This unseating creates a flow path that is opened between the liquid storage vessel interior and a space between the core 32 and the stopper body inner shell 22, permitting liquid contents to be poured out from the interior of the vessel. Counter rotation of the twist to pour plug main core 32 returns the plug to its closed and sealed position. FIG. 3 best illustrates the function in the closed position however FIG. 9 depicts the cavities 40 which make it easy to understand that the plug's rotation would elevate the cavities 40 above the interface of the peripheral gasket 38 to the seat on the inner sell 22 forming the flow path for liquid flow.

Figure 13:
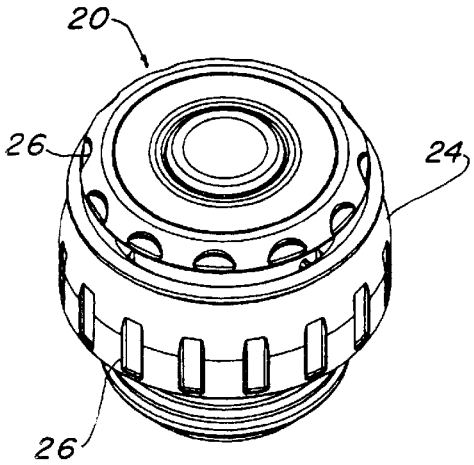
FIG. 13 is a partial isometric view of the push to pour embodiment of the stopper.

The push to pour preferred embodiment, is shown in FIGS. 13 thorough 31 and consists of the exact same stopper body 20 as used in the previous embodiment which comprises the inner shell 22, outer shell 24 and the annular gasket 30.

The plug itself is unique however, and is illustrated alone in FIGS. 19–30. The plug consists of a hollow flanged hub insert 42 formed with a plurality inward linear slots 44 within the inserts hollow inside portion. The insert 42 is illustrated alone in FIG. 22 and shown as an assembly in FIGS. 14 and 17.

The insert 42 has a hollow push button 46 that is nested inside and includes a plurality of outwardly depending alignment ribs 48 and sloped fingers 50. As the push button is slideably disposed within the hub insert 42, the alignment ribs interface with the flanged hub linear slots 44 to prevent the push button 46 from rotating when it is slid linearly within the hub insert 42.

Figure 31:
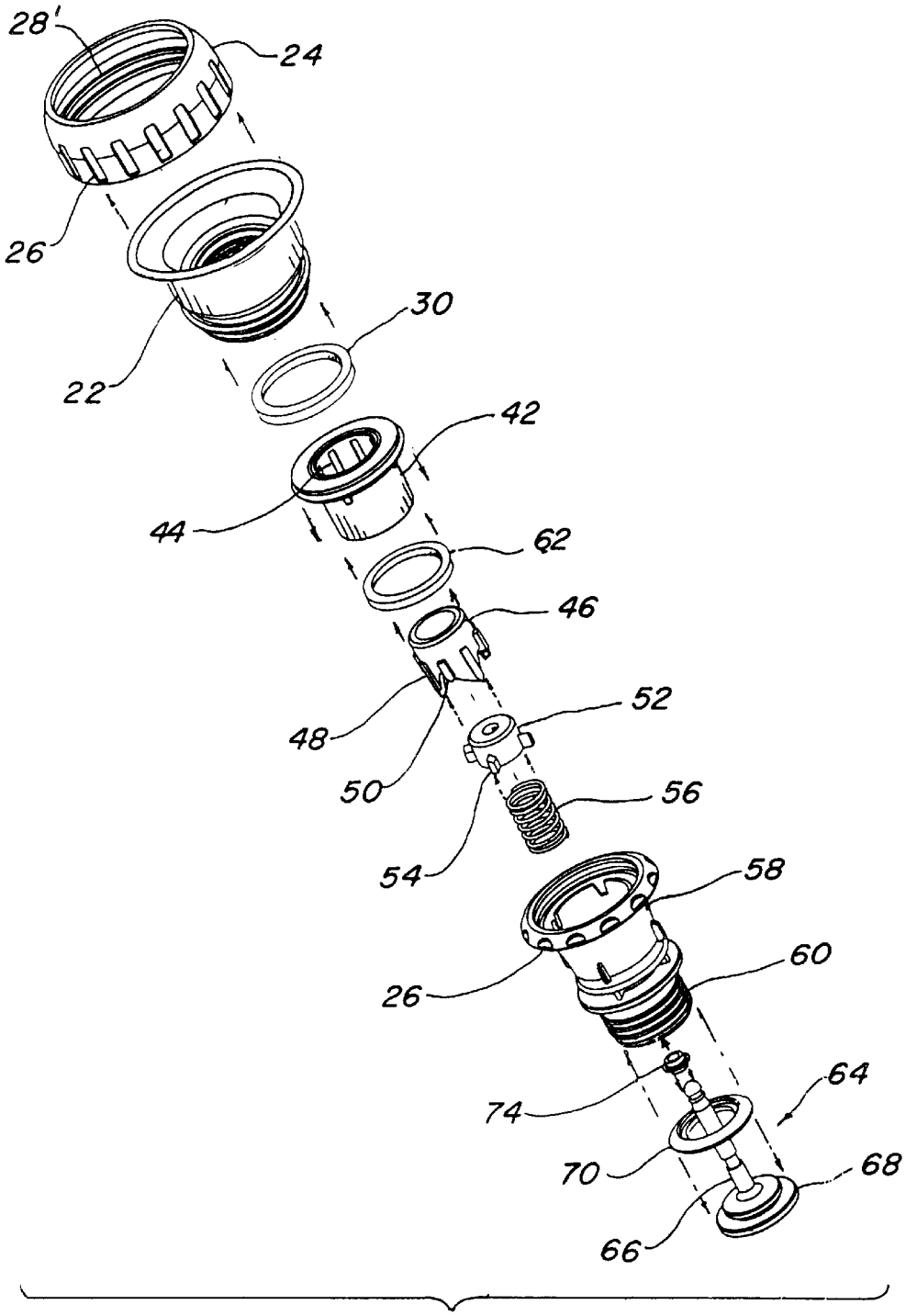
FIG. 31 is an exploded view of the push to pour embodiment of the stopper embodiment of the stopper.

A hollow push button rotary force ring 52, having a plurality of sloped spikes 54 protruding outwardly therefrom, interfaces with the sloped fingers 50 of the hub insert 42. A compression spring 56 is disposed within the rotary force ring 52 urging it to remain contiguously engaged with the hub insert 42 until it is manually depressed. The relationship of the above elements, in their sequence, is illustrated in the exploded view of FIG. 31 and by themselves sequentially in FIGS. 22–25.

A stopper main hub 58 is disposed within the body inner shell 22. The main hub 58 includes a plurality of main hub threads 60 on a lower end permitting the hub 58 to threadably engage the mating threads 28 in the body inner shell 22. A plurality of recesses 26 are located on its outside surface, providing a gripable face for attaching the hub 58 to the stopper body inner shell 22.

A peripheral hub gasket 62 grips the stopper main hub 58 and is in contact with the inner shell 22 when the hub is rotatably tighten in place, forming a liquid tight seal between the stopper plug and the stopper body.

A valve plunger 64 includes a stem 66 on a first end and a circular disc 68 on a second end, with the first end engaging the push button rotary force ring 52. A plunger to hub sealing gasket 70 is mounted into a horizontal recess 72 of the stem 66 and a plunger to hub linear gasket 74 provides a seal between the plunger 64 and the stopper main hub 58. The gaskets 62, 70 and 74 have the same composition as outlined for gaskets 30 and 38. The material of the remainder of the stopper plug is also the same as delineated for the stopper body 20.

In operation, when the push button 46 is depressed the first time, the push button 46, under spring pressure, urges the force ring 52 down while simultaneously unseating the valve plunger 64 allowing a passageway to be opened through the main hub 58 and between the hub 58 and the stopper body inner shell 22. This action permits liquid to be poured from the stopper. The rotary force ring 52 rotates sufficiently to engage the ring's sloped spikes 54 with the sloped fingers 50 of the hub insert 42 retaining the stopper in the open condition, When the push button 46 is depressed sequentially the second time, the ring's sloped spikes 54 and sloped fingers 50 disengage, and under spring pressure, the force ring 62 and valve plunger 64 return to their normally closed position terminating the flow of liquid through the stopper.

Figure 14:
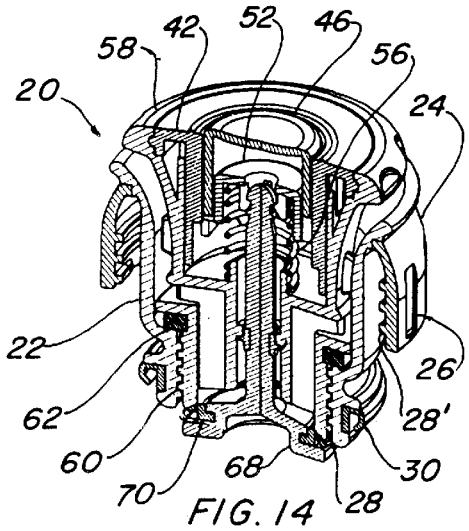
FIG. 14 is a cut away partial isometric view of the push to pour embodiment of the stopper.
Figure 15:
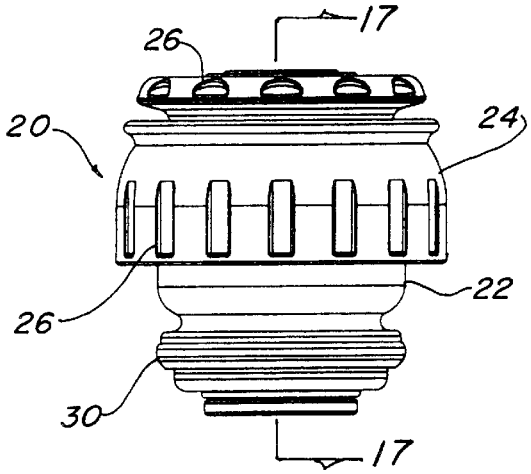
FIG. 15 is a side elevation view of the push to pour embodiment of the stopper.
Figure 16:
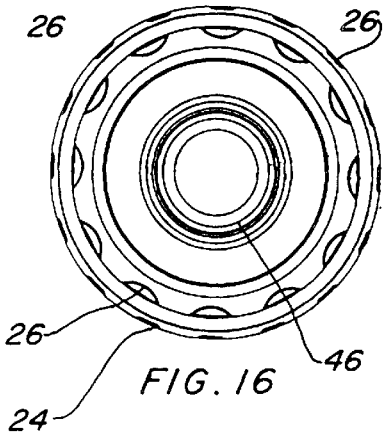
FIG. 16 is a top elevation view of the push to pour embodiment of the stopper.
Figure 17:
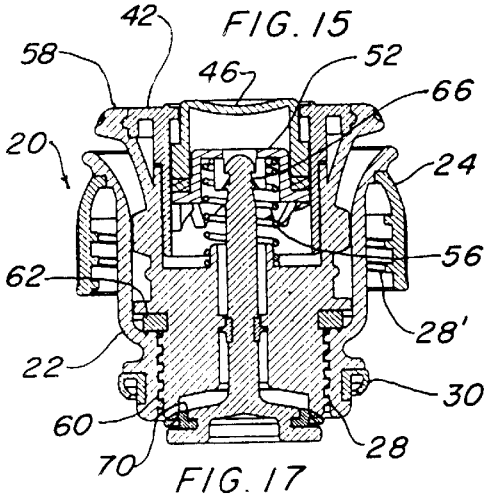
FIG. 17 is a cross sectional view taken along lines 17—17 of FIG. 15.
Figure 18:
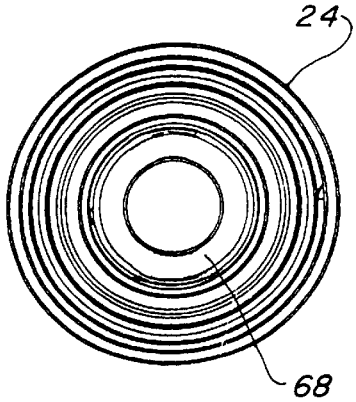
FIG. 18 is a bottom elevation view of the push to pour embodiment of the stopper.
Figure 19:
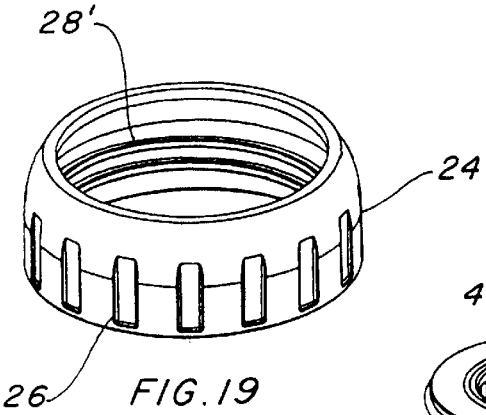
FIG. 19 is a partial isometric view of the stopper body outer shell of the push to pour embodiment of the stopper completely removed from the invention for clarity.
Figure 26:
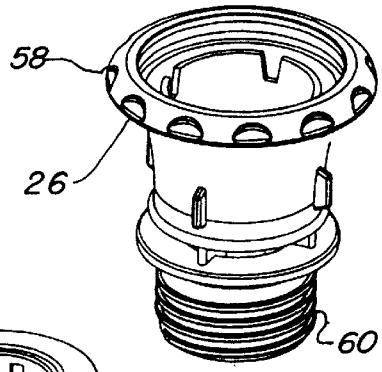
FIG. 26 is a partial isometric view of the stopper main hub of the push to pour embodiment of the stopper completely removed from the invention for clarity.
Figure 22:
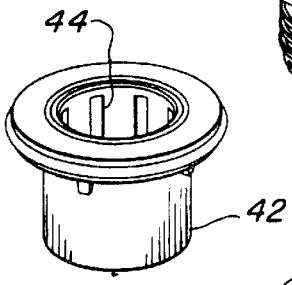
FIG. 22 is a partial isometric view of the hub insert of the push to pour embodiment of the stopper completely removed from the invention for clarity.
Figure 27:
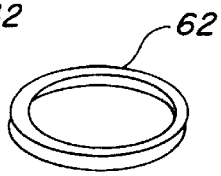
FIG. 27 is a partial isometric view of the peripheral hub gasket of the push to pour embodiment of the stopper completely removed from the invention for clarity.
Figure 20:
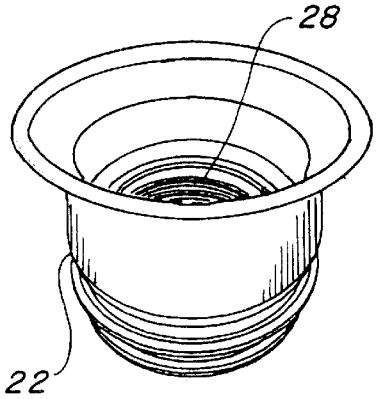
FIG. 20 is a partial isometric view of the stopper body inner shell of the push to pour embodiment of the stopper completely removed from the invention for clarity
Figure 23:
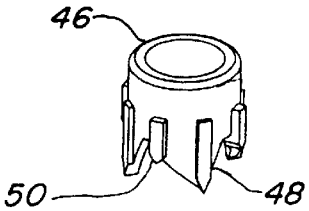
FIG. 23 is a partial isometric view of the push button of the push to pour embodiment of the stopper completely removed from the invention for clarity.
Figure 28:
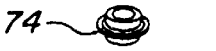
FIG. 28 is a partial isometric view of the plunger to hub linear gasket of the push to pour embodiment of the stopper completely removed from the invention for clarity.
Figure 29:
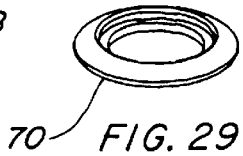
FIG. 29 is a partial isometric view of the plunger to hub sealing gasket of the push to pour embodiment of the stopper completely removed from the invention for clarity.
Figure 21:
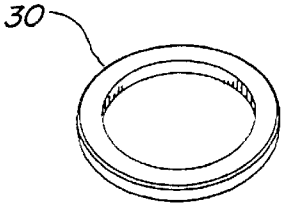
FIG. 21 is a partial isometric view of the annular gasket of the push to pour embodiment of the stopper completely removed from the invention for clarity.
Figure 24:
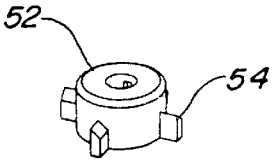
FIG. 24 is a partial isometric view of the rotary force ring of the push to pour embodiment of the stopper completely removed from the invention for clarity
Figure 30:
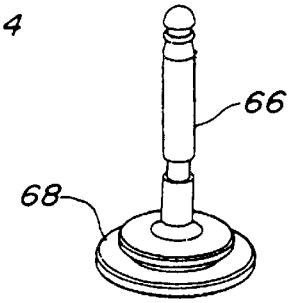
FIG. 30 is a partial isometric view of the stem of the valve plunger of the push to pour embodiment of the stopper completely removed from the invention for clarity.
Figure 25:
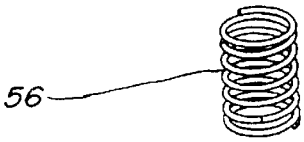
FIG. 25 is a partial isometric view of the compression spring of the push to pour embodiment of the stopper completely removed from the invention for clarity.

FIGS. 14 and 17 depict the operation in the normally closed condition however it may easily be visualized that when the above sequence is followed the flow path is obvious, particularly when perceived in the cutaway view of FIG. 14.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A liquid storage vessel stopper with interchangeable plugs comprising, a stopper bode having an inner shell affixed to an outer shell, said inner shell configured to communicate with a liquid storage vessel interior, and said outer shell profiled to be threadably attached to an outside surface of a vessel, said inner shell having threads for interfacing with a stopper plug, and a annular gasket seated thereon for sealing the shell to a storage vessel interior, in a liquid tight manner, said outer shell having threads for interfacing with opposed threads of a liquid storage vessel, said stopper body outer shell further having a plurality of recesses on an outside surface, providing a gripable face for attaching the body to a liquid storage vessel, an interchangeable stopper plug selected from the group consisting of a twist to pour plug and a push to pour plug, said twist to pour plug having a hollow main core smaller in size yet contoured in like manner as the stopper body inner shell interior, with core mating threads that connect to the body threads, for interfacing with a stopper plug, a lid snapped into place onto the hollow main core enclosing the core creating a dead air space within as an insulating barrier, a peripheral core gasket hermetically sealing the core to the stopper body inner shell, said core mating threads having interruptions in the form of a pair of opposed cavities such that when the twist to pour plug main core is manually rotated, at least a quarter of a turn, the peripheral gasket is unseated and a flow path is opened between the liquid storage vessel interior and a space between the core and the stopper body inner shell permitting liquid contents to be poured out of the interior of the vessel, and counter rotation of the twist to pour plug main core returns the plus to a closed and sealed position, said push to pour pus having, a hollow flanged hub insert, defined with a plurality inward linear slots within the hollow portion thereof, a hollow push button having a plurality of outwardly depending alignment ribs and sloped fingers, with the push button slideably disposed within the hub insert, and said alignment ribs interfacing with the flanged hub linear slots for preventing the push button from rotating when the push button is slid linearly within the hub insert, a hollow push button rotary force ring having a plurality of sloped spikes protruding outwardly therefrom, interfacing with the sloped fingers of the hub insert, a compression spring disposed within the rotary force ring urging the ring to remain contiguously engaged with the hub insert until manually depressed, a unitary stopper main hub, having a passageway therethrougth, disposed within the body inner shell, said main hub having a plurality of threads on a lower end permitting the hub to threadably engage mating stopper threads in the body inner shell, a peripheral hub gasket gripping the stopper main hub contiguous with the inner shell when the hub is rotatably tighten in place, forming a liquid tight seal therebetween, a valve plunger defined as a stem having a first end and a second end with the first end engaging the push button rotary force ring and the second end having a circular end disc with a plunger to hub sealing gasket mounted into a horizontal recess in the stem, also said valve plunger having a plunger to hub linear gasket sealing between the plunger and the stopper main hub, and when said push button is depressed under spring pressure a first time, the push button urges the force ring down while simultaneously unseating the valve plunger allowing a passageway to be opened through the main hub and between the hub and the stopper body inner shell permitting liquid to be poured from the stopper, further the rotary force ring rotates sufficiently to engage the ring's sloped spikes with the sloped fingers of the hub insert retaining the stoppers open condition, when the push button is depressed sequentially a second time, the ring's sloped spikes and sloped fingers of the hub insert disengage and under spring pressure the force ring and valve plunger return to their normally closed position terminating the flow of liquid through the stopper.

2. The liquid storage vessel stopper as recited in claim 1 wherein said hollow main core and stopper main hub having a plurality of recesses on an outside surface, providing a gripable face for attaching the plug to the stopper body.

3. The liquid storage vessel stopper as recited in claim 1 wherein said stopper body and said stopper plug are formed of a thermoplastic selected from the group consisting of cellulose, phenolic, phenylene oxide, polycarbonate, polyester, polyethylene, polypropylene, polystyrene, acetyl, polyester, phenylene oxide, polymide and poly vinyl chloride.

4. The liquid storage vessel stopper as recited in claim 1 wherein said annular gasket, peripheral core gasket, peripheral hub gasket, plunger to hub linear gasket and plunger to hub sealing gasket are formed of a resilient material selected from the group consisting of, natural rubber, synthetic rubber and resilient thermoplastic, including silicone, neoprene, and viton.

5. A liquid storage vessel stopper with interchangeable plugs comprising, a stopper body having an inner shell affixed to an outer shell, said inner shell configured to communicate with a liquid storage vessel interior, and said outer shell profiled to be threadably attached to an outside surface of a vessel, said inner shell having threads for interfacing with a stopper plug, and a annular gasket seated thereon for sealing the shell to a storage vessel interior, in a liquid tight manner, said outer shell having threads for interfacing with opposed threads of a liquid storage vessel, said stopper body outer shell further having a plurality of recesses on an outside surface, providing a gripable face for attaching the body to a liquid storage vessel, an interchangeable stopper plug consisting of a push to pour plug, said push to pour plug having a hollow flanged hub insert defined with a plurality inward linear slots within the hollow portion thereof, a hollow push button having a plurality of outwardly depending alignment ribs and sloped fingers, with the push button slideably disposed within the hub insert, with said alignment ribs interfacing with the flanged hub linear slots for preventing the push button from rotating when the push button is slid linearly within the hub insert, a hollow push button rotary force ring having a plurality of sloped spikes protruding outwardly therefrom, interfacing with the sloped fingers of the hub insert, a compression spring disposed within the rotary force ring urging the ring to remain contiguously engaged with the hub insert until manually depressed, a unitary stopper main hub, having a passageway therethrougth, disposed within the body inner shell, said main hub having a plurality of threads on a lower end permitting the hub to threadably engage mating stopper threads in the body inner shell, a peripheral hub gasket gripping the stopper main hub contiguous with the inner shell when the hub is rotatable tighten in place, forming a liquid tight seal therebetween, a valve plunger defined as a stem having a first end and a second end with the first end engaging the push button rotary force ring and the second end having a circular end disc with a plunger to hub sealing gasket mounted into a horizontal recess in the stem, also said valve plunger having a plunger to hub linear gasket sealing between the plunger and the stopper main hub, and when said push button is depressed under spring pressure a first time, the push button urges the force ring down while simultaneously unseating the valve plunger allowing a passageway to be opened through the main hub and between the hub and the stopper body inner shell permitting liquid to be poured from the stopper, further the rotary force ring rotates sufficiently to engage the ring's sloped spikes with the sloped fingers of the hub insert retaining the stoppers open condition, when the push button is depressed sequentially a second time, the ring's sloped spikes and sloped fingers of the hub insert disengage and under spring pressure the force ring and valve plunger return to their normally closed position terminating the flow of liquid through the stopper.

6. The liquid storage vessel stopper as recited in claim 5 wherein stopper main hub having a plurality of recesses on an outside surface, providing a gripable face for attaching the plug to the stopper body.

7. The liquid storage vessel stopper as recited in claim 5 wherein said stopper body and said stopper plug are formed of a thermoplastic selected from the group consisting of cellulose, phenolic, phenylene oxide, polycarbonate, polyester, polyethylene, polypropylene, polystyrene, acetyl, polyester, phenylene oxide, polymide and poly vinyl chloride.

8. The liquid storage vessel stopper as recited in claim 5 wherein said annular gasket, peripheral hub gasket, plunger to hub linear gasket and plunger to hub sealing gasket are formed of a thermoplastic selected from the group consisting of, natural rubber, synthetic rubber and resilient thermoplastic, including silicone, neoprene, and viton.

* * * * *